US005088120A

United States Patent [19]

Yen

[11] Patent Number: 5,088,120

[45] Date of Patent: Feb. 18, 1992

[54] COMBINED AND FIXED NECKTIE

[75] Inventor: Chen-Chou Yen, Tainan, Taiwan

[73] Assignee: Ching Yang Necktie Co., Ltd., Tainan, Taiwan

[21] Appl. No.: 678,545

[22] Filed: Mar. 26, 1991

[51] Int. Cl.[5] ..... A41D 25/14

[52] U.S. Cl. ..... 2/152 R; 2/153; 2/150

[58] Field of Search ..... 2/152 R, 153, 148, 144, 2/155, 156, 149, 150

[56] References Cited

U.S. PATENT DOCUMENTS

| | | | |
|---|---|---|---|
| 1,438,885 | 12/1922 | Almedia | 2/153 |
| 2,529,957 | 11/1950 | Newman | 2/153 |
| 2,605,473 | 8/1952 | Halsey | 2/153 |
| 3,187,396 | 6/1965 | Carroll | 2/148 |
| 3,235,880 | 2/1966 | Hypps | 2/152 R |
| 3,745,614 | 7/1973 | Tsang | 2/148 |
| 3,942,192 | 3/1976 | Harris | 2/152 R |
| 4,368,544 | 1/1983 | Smith | 2/156 |
| 4,748,692 | 6/1988 | Fukushima | 2/152 R |
| 4,771,481 | 9/1988 | Gasser | 2/152 R |
| 4,995,118 | 2/1991 | Paduano, Sr. | 2/152 R |

FOREIGN PATENT DOCUMENTS

| | | | |
|---|---|---|---|
| 7900894 | 11/1979 | PCT Int'l Appl. | 2/148 |

*Primary Examiner*—Werner H. Schroeder
*Assistant Examiner*—Amy Brooke Vanatta
*Attorney, Agent, or Firm*—Morton J. Rosenberg; David I. Klein

[57] ABSTRACT

A combined and fixed necktie having a necktie body, a sheath member, an adjusting plate, a neck rope and a neck rope retainer. The adjusting plate can adjust and fix the length of the necktie body which is inserted into rectangular apertures of the adjusting plate. The twined necktie body and adjusting plate can be fixed in the sheath member. The rope retainer being fixed in the sheath member can control the diameter of the neck rope so that is is very convenient and easy for the wearer to wear or remove the necktie.

1 Claim, 4 Drawing Sheets

COMBINED AND FIXED NECKTIE

BACKGROUND OF THE INVENTION

1. Field of the Invention

This invention relates to a combined and fixed necktie having an adjusting plate with rectangular apertures to fix and adjust the necktie body and having a specially designed neck rope retainer in which there is a central longitudinal divisional plate and an arc spring pincer whose inward spring pressure controls the length of the neck rope.

2. Description of the Prior Art

Neckties being known and used in general are woven products for being tied on the neck. However, it is very unconvenient and toilsome for wearers to tie and adjust the known neckties so as to have satisfactory shapes every time. Moreover, the finished shapes of the known neckties are still very possible to be out of shape after a long time, which surely makes wearers embarrassed in normal situations.

SUMMARY OF THE INVENTION

Therefore, it is a principle object of the present invention to provide a neck rope retainer in which there is a central longitudinal divisional plate and an arc spring pincer whose both ends are inwardly squeezed and whose front part has two holes corresponding to another two holes placed on the top wall of the neck rope retainer. When assembling the neck rope retainer, the two ends of the neck rope inlay into the neck rope retainer from the two holes of the top wall of the neck rope retainer to those of the spring pincer, and then are pinched by the central divisional plate and the two squeezed ends of the arc spring pincer.

BRIEF DESCRIPTION OF THE DRAWING

The invention will be better understood by reference to the accompanying drawings, wherein.

DESCRIPTION OF THE PREFERRED EMBODIMENTS

Figure 1:
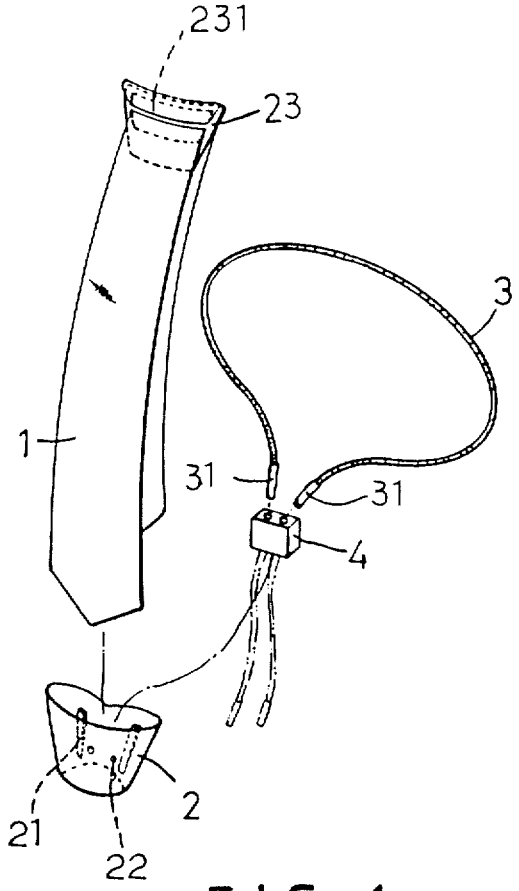
Figure 2D:
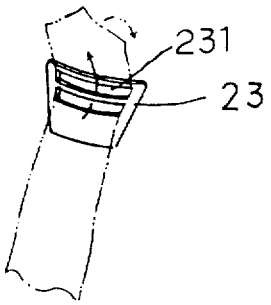

As shown in FIG. 1, the present invention is concerned with a necktie body 1, a sheath member 2, an adjusting plate 23, a neck rope 3 and a neck rope retainer 4.

Figure 1A:
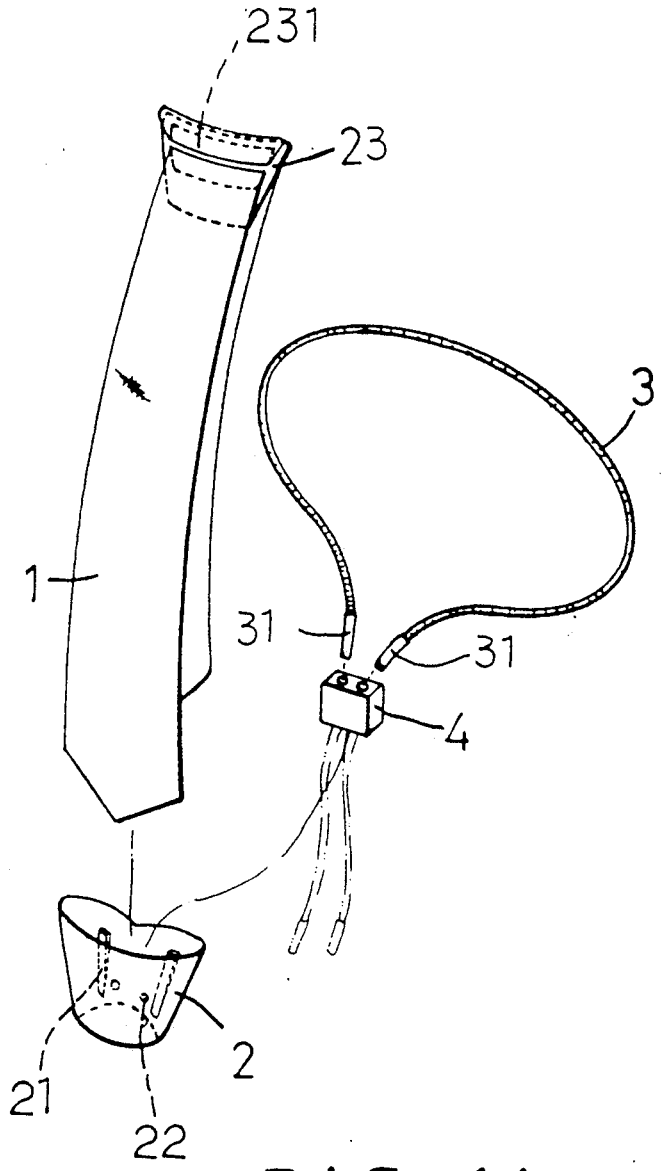
FIG. 1 is a perspective view showing the disassembling of a preferred embodiment of the invention.
Figure 2D:
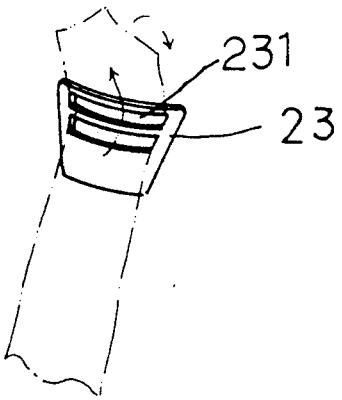
FIG. 2D is a perspective view showing the adjusting plate.
Figure 2A:
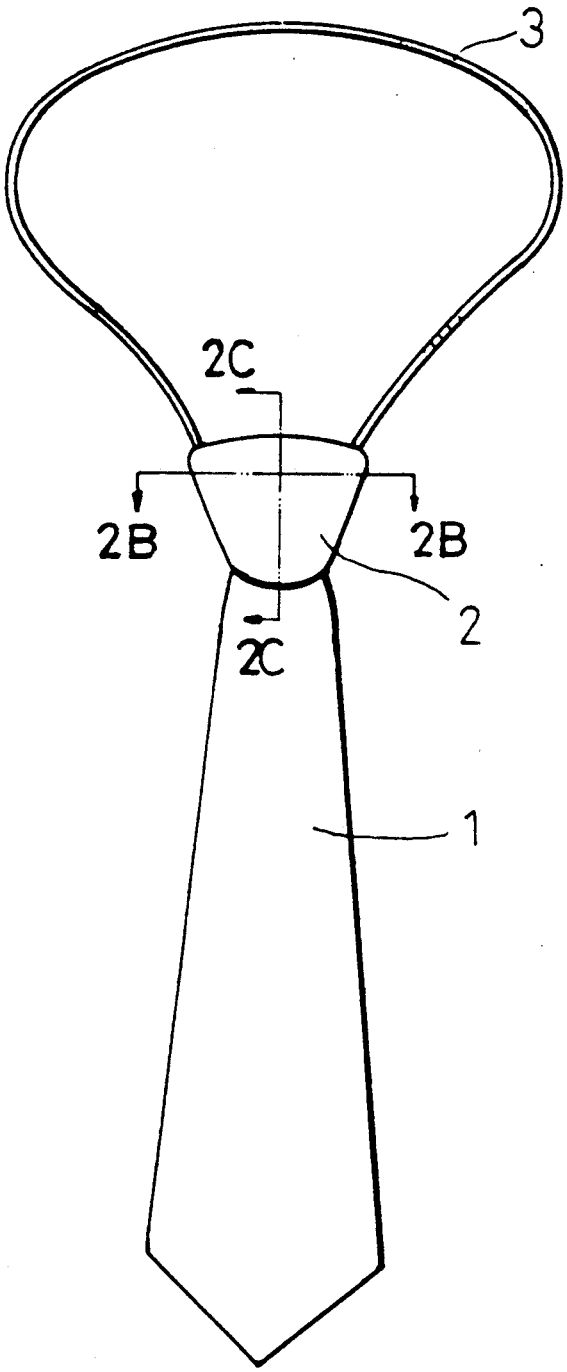
FIG. 2A is a view showing the front of the preferred embodiment of the invention.
Figure 2B:
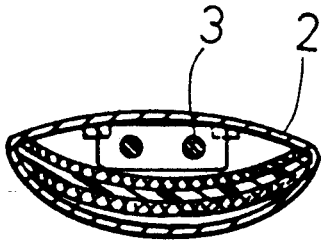
FIG. 2B is a sectional view showing the 2B—2B part of the fixed bow tie in FIG. 2A.
Figure 2C:
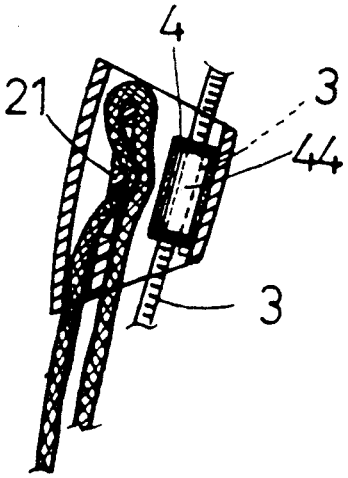
FIG. 2C is a sectional view showing the 2C—2C part of the fixed bow tie in FIG. 2A.
Figure 3:
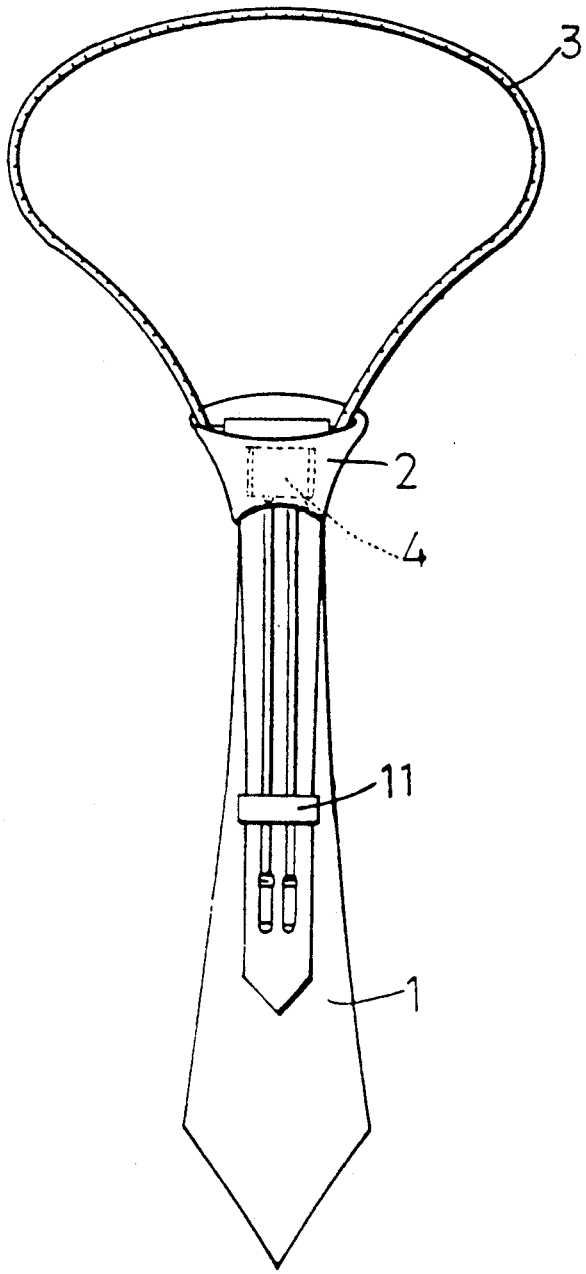
FIG. 3 is a view showing the back of the preferred embodiment of the invention.
Figure 5:
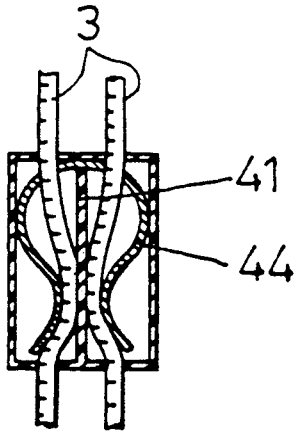
FIG. 5 is a top view showing the assembling of the neck rope retainer of the preferred embodiment of the invention.

The necktie body 1, a woven product, has the same shape as any common necktie, but has a cloth-made retaining ring 11 sewn on the back, as shown in FIGS. 1, 2 and 3.

The sheath member 2, a hollow mono-block metal, may be made to be the same shape, pattern and color as the necktie body 1 or may have other treatments such as carving, varnish-baking and gem-mounting. Inside the back of the sheath member 2, two protrudent strips 21 and two non-slipping blocks 22 which are locate near the bottom of the protrudent strips 21 are fixed so that the inserting neck rope retainer 4 can be held in the sheath member 2 in a fixed position, as shown in FIG. 1 and FIG. 2—2.

The adjusting plate 23 having rectangular apertures 231 is good for the twine and the fixation of the necktie body 1. The twined adjusting plate and necktie body can also insert and be fixed in the sheath member 2, as shown in FIG. 1, 2-1 and 2-2.

The neck rope 3, made of soft and wearing material, has two pipe rings 31 covered on its two ends so that these two ends will not get loosened. The two ends of the neck rope 3 penetrates the neck rope retainer 4 and are controlled by the neck rope retainer 4 so as to form a ring for the wearer to hang on the neck. The neck rope 3 is able to bear the total weight of the necktie body 1, the sheath member 2 and the neck rope retainer 4.

Figure 4:
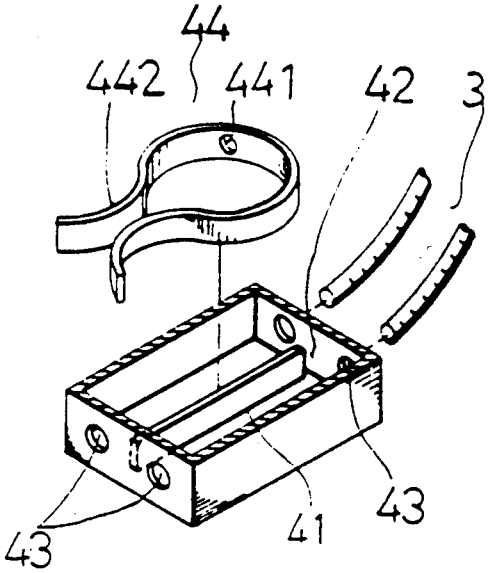
FIG. 4 is a perspective view showing the disassembling of the neck rope retainer of the preferred embodiment of the invention.

The neck rope retainer 4, a box, has a central longitudinal divisional plate 41 leaving a gap 42 between the top of the central longitudinal divisional plate and the inside top wall of the neck rope retainer 4. An arc spring pincer 44 with two inwardly squeezed ends 442 is placed in the gap, between the central longitudinal divisional plate and the walls of the neck rope retainer 4. The front part of the arc spring pincer 44 has two holes corresponding to another two holes 43 opened on the top wall of the neck rope retainer 4, as shown in FIG. 4.

When assembling the necktie of the invention, penetrate the neck rope 3 into the top holes 43 of the neck rope retainer 4 as well as the holes 441 of the arc spring pincer 44 and through the bottom holes 43 of the neck rope retainer 4, by which these two ends of the neck rope 3 will be clamped between the central divisional plate 41 and the squeezed ends 442 of the arc spring pincer 44 so that the wearer can completely control the diameter of the neck rope 3 by the pulling of the neck rope 3 upwardly or downwardly. Therefore, it is very easy for the wearer to wear or take off the necktie of the invention.

Figure 6:
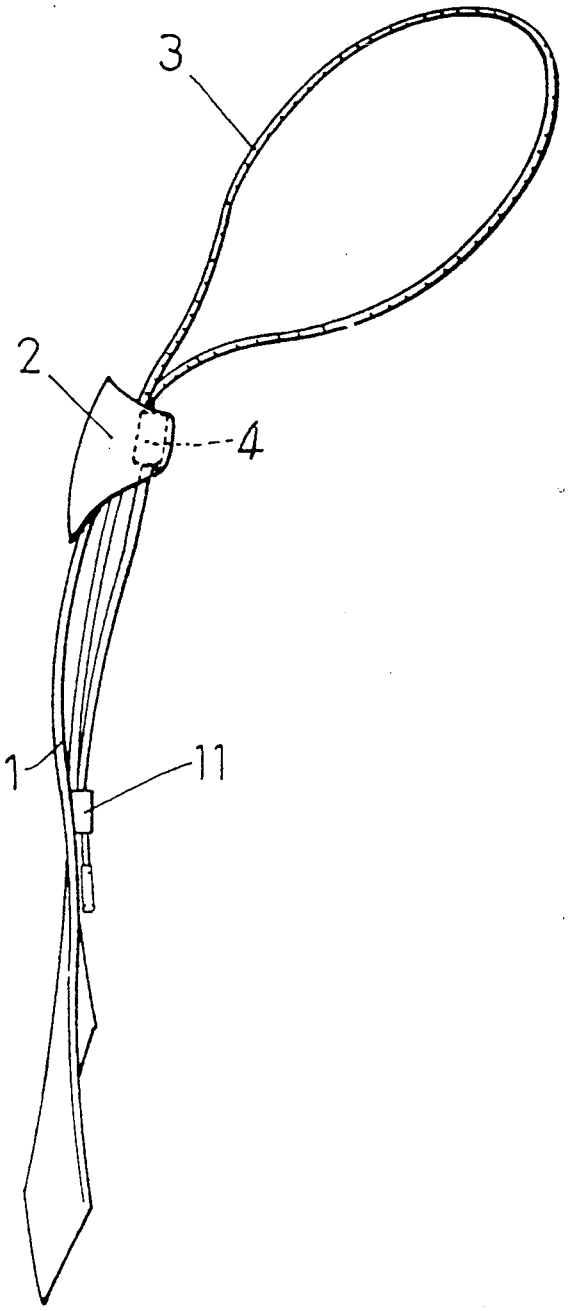
FIG. 6 is a view showing the appearance of the preferred embodiment of the invention.

When wearing the necktie of the invention, the wearer only needs to put the neck rope 3 on the neck and then pull both ends of the neck rope 3 downwardly, by which the arc spring pincer 44 of the neck rope retainer 4 will adjust the diameter of the neck rope 3 so as to fit the wearer's neck. Finally, insert the pipe rings 31 of the neck rope 3 into the cloth-made retaining ring 11, as shown in FIG. 6. However, when taking off the necktie, the wearer has to pull the neck rope 3 upwardly so that the enlarged diameter of the neck rope 3 is very easy for the wearer to take off from the neck.

Therefore, the design of the adjusting plate 23 is helpful to adjust and fix the required length of the necktie body 1. The movement of pulling the neck rope 3 upwardly or downwardly will control the diameter of the neck rope 3 so that the wearer can wear or take off the necktie of the invention easily. Moreover, the fixed shape of the sheath member 2 makes the wearer not have to tie the necktie every time and not to worry about having an out-of-shape necktie. The sheath member 2 of the invention which can be treated with different types of decoration will always provide the wearer a new and proud necktie.

While the preferred embodiments of the invention have been described above, it will be recognized and understood that various modifications may be made therein and the appended claims are intended to cover all such modifications which may fall within the spirit and scope of the invention.

What is claimed is:

1. A combined and fixed necktie comprising:

(a) a necktie body;

(b) an adjusting plate member having rectangularly contoured apertures for passage therethrough of said necktie body for fixing the length of said necktie body when worn by a user;

(c) a metallic sheath member having a through opening for insertion of said adjusting plate member and a neck rope retainer, said metallic sheath member having a pair of protruding strip members and a pair of non-slipping block members formed on an inner surface of said metallic sheath member for contacting and intercepting the path of said neck rope retainer when said neck rope retainer is inserted within said metallic sheath member;

(d) said neck rope retainer having a box contour, said neck rope retainer including a centrally located longitudinally extending divider plate fixed to a wall of said neck rope retainer, and an arcuately contoured spring pincer member having inwardly biased end sections, said arcuately contoured spring pincer member being positionally located between a pair of transversely displaced wall members and said divider plate of said neck rope retainer, said spring pincer member having a pair of receiving holes formed through a frontal section thereof for alignment with a pair of retainer holes formed through a frontal wall of said rope retainer; and, (e) a flexible neck rope member having a pair of fitted pair rings secured to opposing ends thereof, said flexible neck rope insertable through said retainer holes and said receiving holes, said flexible neck rope member being clamped between said divider plate and said inwardly biased end sections of said spring pincer member, said flexible neck rope member extending through a pair of openings formed through a rear wall of said neck rope retainer.

* * * * *

UNITED STATES PATENT AND TRADEMARK OFFICE

CERTIFICATE OF CORRECTION

PATENT NO. : 5,088,120

DATED : FEB. 18, 1992

INVENTOR(S) : CHEN-CHOU YEN

It is certified that error appears in the above-identified patent and that said Letters Patent is hereby corrected as shown below:

IN THE DRAWINGS:

DELETE THE LEGEND "FIG. 1A" AND INSERT THEREFOR THE LEGEND --FIG. 1--

Signed and Sealed this

Eighth Day of June, 1993

*Attest:*

*Attesting Officer*

Michael K. Kirk

MICHAEL K. KIRK

*Acting Commissioner of Patents and Trademarks*